US009132339B1

(12) United States Patent
Smith et al.

(10) Patent No.: US 9,132,339 B1
(45) Date of Patent: Sep. 15, 2015

(54) FLEXIBLE BILLIARDS BALL RACK

(71) Applicants: Denver B. Smith, York, SC (US); Dustin B. Smith, York, SC (US)

(72) Inventors: Denver B. Smith, York, SC (US); Dustin B. Smith, York, SC (US)

( * ) Notice: Subject to any disclaimer, the term of this patent is extended or adjusted under 35 U.S.C. 154(b) by 58 days.

(21) Appl. No.: 14/101,575

(22) Filed: Dec. 10, 2013

(51) Int. Cl.
*A63D 15/00* (2006.01)

(52) U.S. Cl.
CPC ..... *A63D 15/005* (2013.01)

(58) Field of Classification Search
CPC ..... A63D 15/00; A63D 15/005
USPC ..... 473/26, 40, 41, 1
See application file for complete search history.

(56) References Cited

U.S. PATENT DOCUMENTS

| | | | | | |
|---|---|---|---|---|---|
| 128,855 | A * | 7/1872 | Collender | 473/1 |
| 283,732 | A * | 8/1883 | Wiggins | 473/40 |
| 464,745 | A * | 12/1891 | Sweet | 473/40 |
| 702,108 | A * | 6/1902 | Marshall | 473/40 |
| 743,464 | A * | 11/1903 | D'Abramo | 473/40 |
| 1,660,626 | A * | 2/1928 | Rhoads | 473/40 |
| 1,796,722 | A * | 3/1931 | Read | 473/40 |
| 1,848,460 | A * | 3/1932 | Budde | 473/40 |
| 2,422,939 | A * | 6/1947 | Volpe | 473/40 |
| 3,253,826 | A * | 5/1966 | Cook | 473/40 |
| 4,903,965 | A * | 2/1990 | Smith | 473/40 |
| D367,306 | S | 2/1996 | Fiscella | |
| 5,601,496 | A | 2/1997 | Beauchamp | |
| D390,902 | S | 2/1998 | Fiscella | |
| 5,716,285 | A | 2/1998 | Maceri | |
| 5,916,032 | A * | 6/1999 | Stoll | 473/40 |
| 7,166,033 | B2 | 1/2007 | Krajeski | |
| 8,216,078 | B1 | 7/2012 | Yovanovich et al. | |
| 8,496,535 | B2 * | 7/2013 | Kaplan | 473/40 |
| 2006/0079339 | A1 * | 4/2006 | Krajeski | 473/40 |
| 2012/0302361 | A1 * | 11/2012 | Kaplan | 473/40 |
| 2013/0040748 | A1 | 2/2013 | Byrne | |

FOREIGN PATENT DOCUMENTS

| | | | | |
|---|---|---|---|---|
| CA | 2138082 A1 * | 6/1996 | | A63D 15/00 |
| CN | 202223866 U * | 5/2012 | | A63D 15/00 |

* cited by examiner

*Primary Examiner* — Mitra Aryanpour
(74) *Attorney, Agent, or Firm* — Kyle A. Fletcher, Esq.

(57) ABSTRACT

The adjustable rack assembly for arranging billiard balls includes a first member that may be positioned on a billiard table. A band is operationally coupled to the first member. A second member is coupled to the band. The second member is movably coupled to the first member. The second member may arrange the billiard balls between the first and second members.

18 Claims, 6 Drawing Sheets

FLEXIBLE BILLIARDS BALL RACK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of billiard racks, more specifically, adjustable billiard racks.

SUMMARY OF THE INVENTION

An embodiment of the disclosure meets the needs presented above by generally comprising a first member that may be positioned on a billiard table. A band is operationally coupled to the first member. A second member is coupled to the band. The second member is movably coupled to the first member. The second member may arrange the billiard balls between the first and second members.

An object of the invention is to provide a billiard ball rack that is adjustable.

These together with additional objects, features and advantages of the flexible billiard ball rack will be readily following detailed description of presently preferred, but nonetheless illustrative, embodiments of the flexible billiard ball rack when taken in conjunction with the accompanying drawings.

In this respect, before explaining the current embodiments of the flexible billiard ball rack in detail, it is to be understood that the flexible billiard ball rack is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flexible billiard ball rack.

It is therefore important that the claims be regarded as including such equivalent construction insofar as they do not depart from the spirit and scope of the flexible billiard ball rack. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
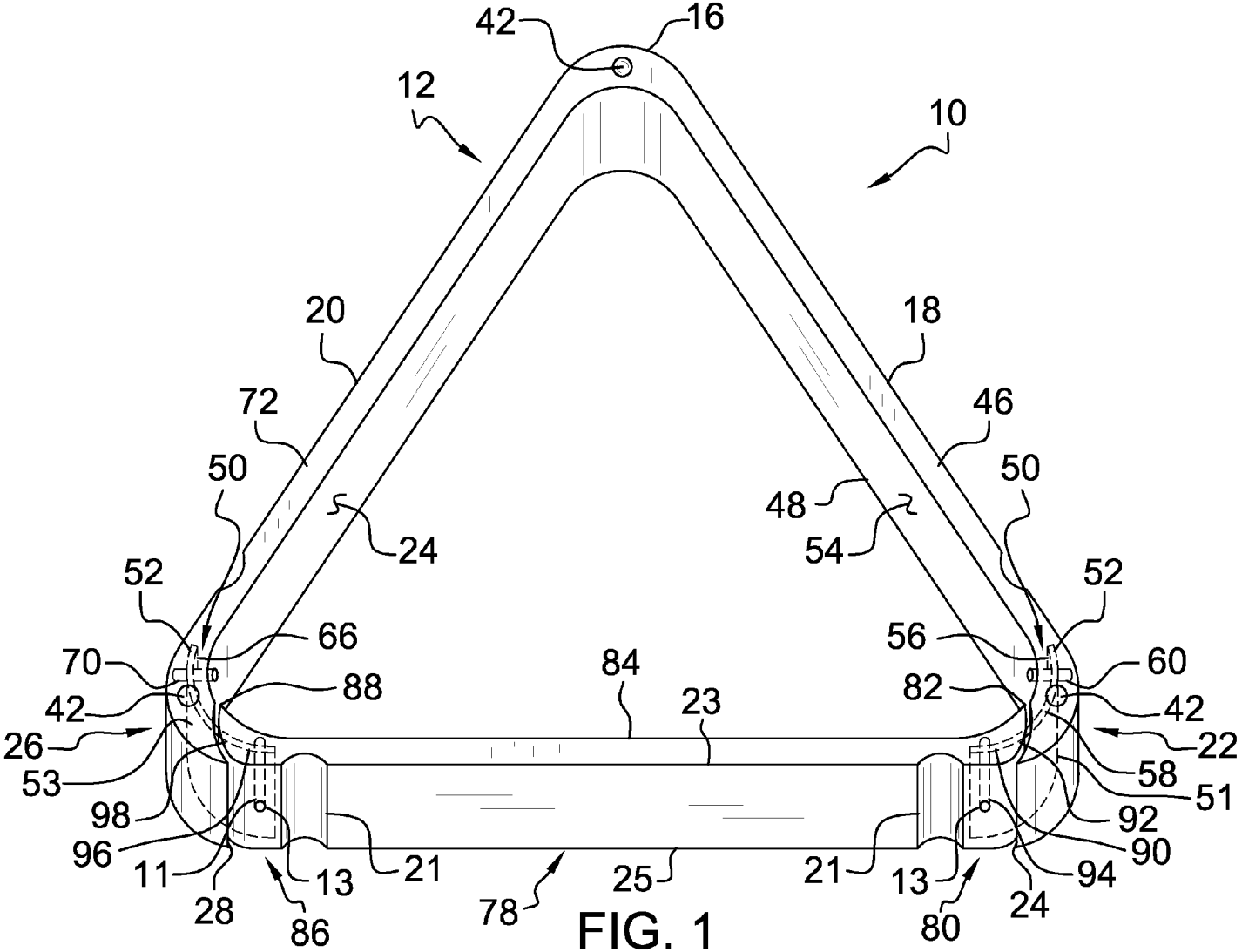
FIG. 1 is a top perspective view of a movable rack assembly according to an embodiment of the disclosure.
Figure 2:
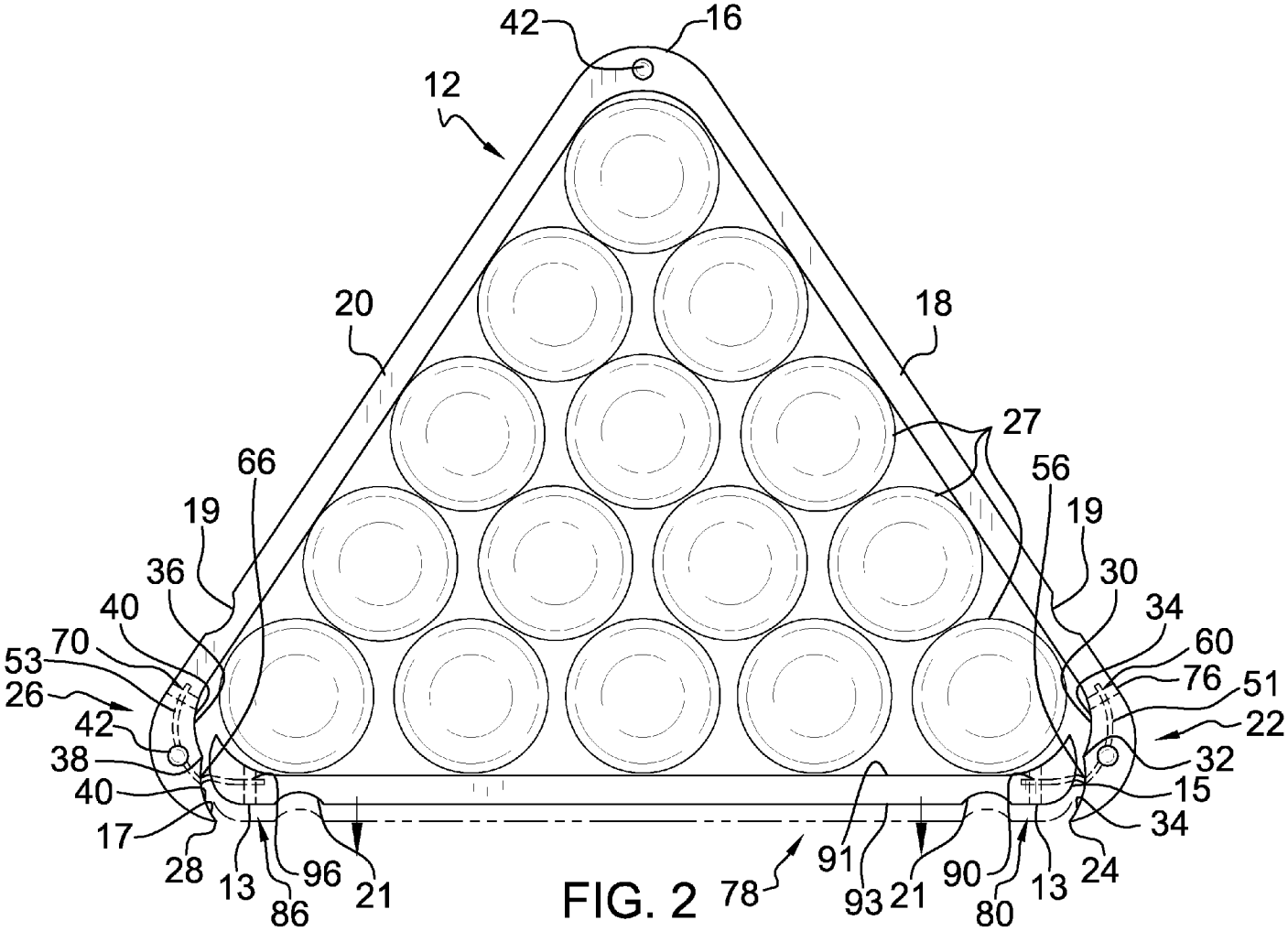
FIG. 2 is a top view of an embodiment of the disclosure.
Figure 3:
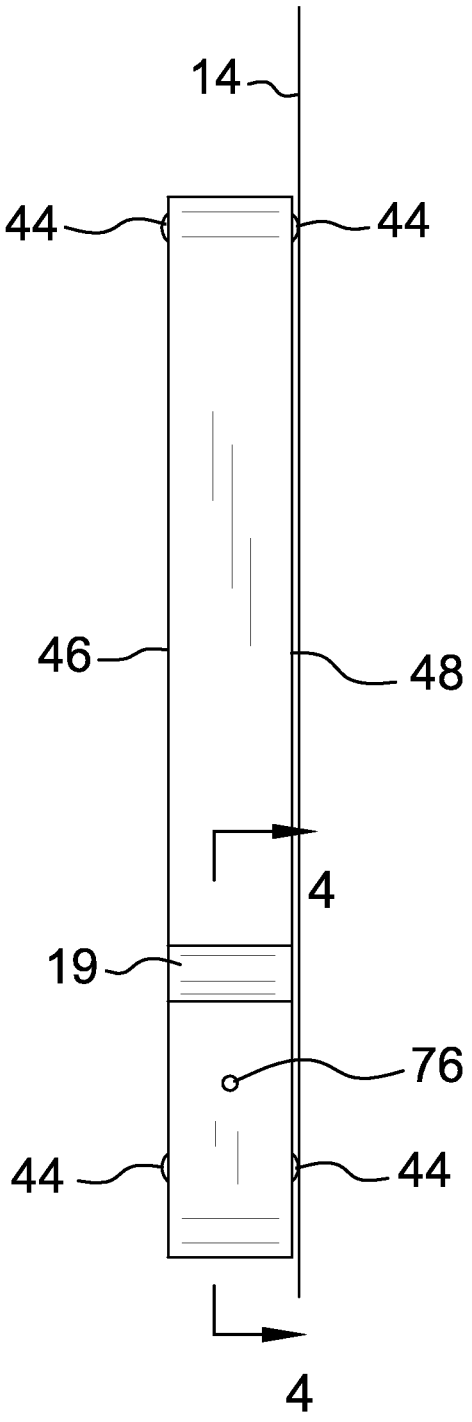
FIG. 3 is a back view of an embodiment of the disclosure.
Figure 4:
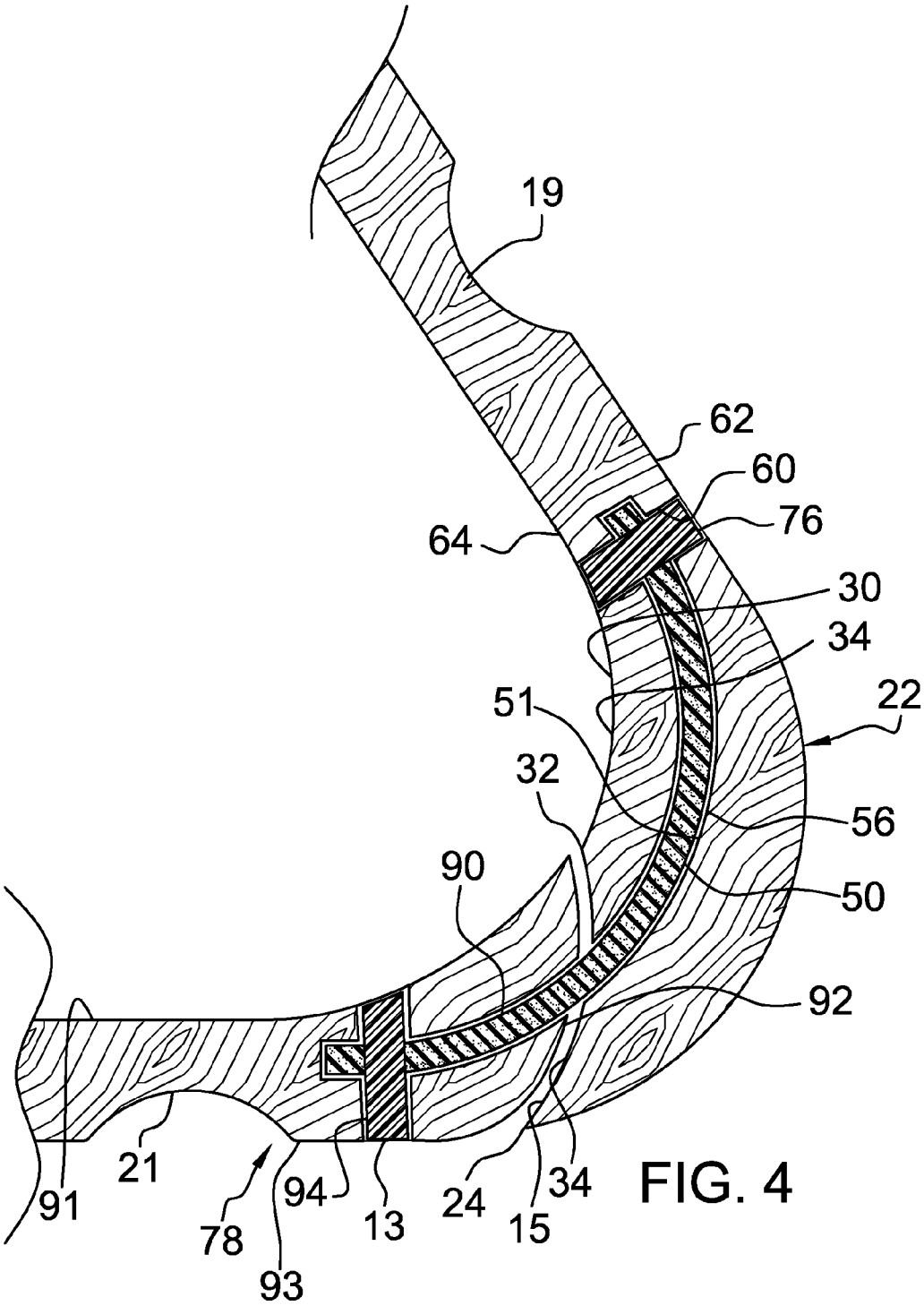
FIG. 4 is a cross sectional view taken along line 4-4 of FIG. 3 of an embodiment of the disclosure.
Figure 5:
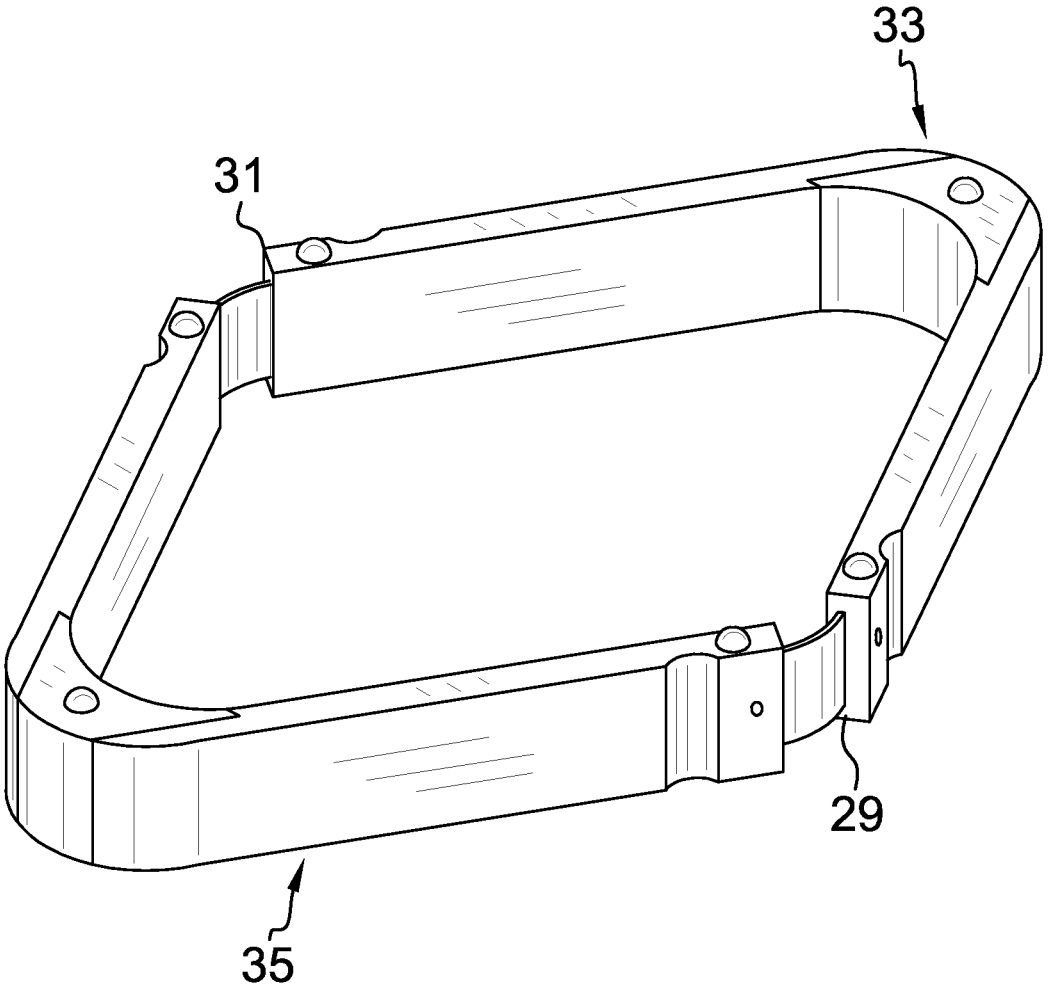
FIG. 5 is a right side perspective view of an alternative embodiment of the disclosure.
Figure 6:
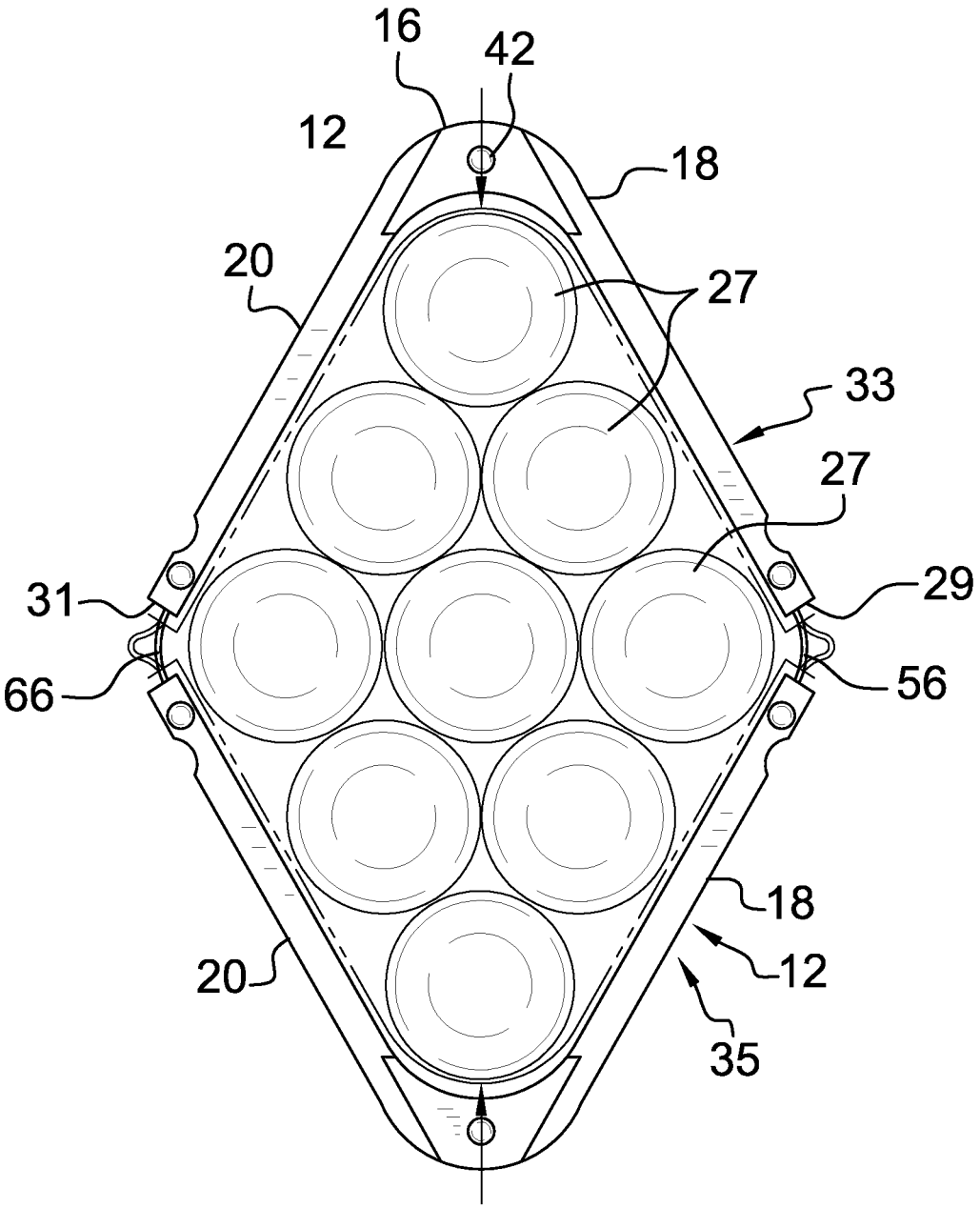
FIG. 6 is a top view of an alternative embodiment of the disclosure.

As best illustrated in FIGS. 1 through 6, the movable rack assembly 10 (hereinafter assembly) generally comprises a first member 12 that may be positioned on a billiard table 14. Continuing, the first member 12 comprises a centrally positioned bend 16 defining a first portion 18 of the first member 12 that forms an acute inside angle with respect to a second portion 20 of the first member 12. Each of the first 18 and second 20 portions of the first member 12 may have a length between 28 cm and 30 cm, a height between 5 cm and 6 cm and a thickness between 6 mm and 9 mm. Moreover, the first 18 and second 20 portions of the first member 12 may form an inside angle between 58° and 62°.

A curved section 22 proximate a free end 24 of the first portion 18 of the first member 12 is curved inwardly toward the second portion 20 of the first member 12. The curved section 22 of the first portion 20 of the first member 12 is hook shaped. Moreover, a curved section 26 proximate a free end 28 of the second portion 20 of the first member 12 is curved inwardly toward the first portion 18 of the first member 12. Additionally, the curved section 26 of the second portion 20 of the first member 12 is hook shaped. The curved sections 22, 26 of each of the first 18 and second 20 portions of the first member 12 may have a length between 5 cm and 10 cm.

An inside surface 30 of the curved section 22 of the first portion 18 of the first member 12 is scalloped. A peak 32 is defined between a pair of troughs 34 on the inside surface 30 of the curved section 22 of the first portion 18 of the first member 12. Additionally, an inside surface 36 of the curved section 26 of the second portion 20 of the first member 12 is scalloped. A peak 38 is defined between a pair of troughs 40 on the inside surface 36 of the curved section 26 of the second portion 20 of the first member 12. Lastly, the peaks 32, 38 on each of the first 18 and second 20 sections of the first member 12 may have a height between 6 mm and 10 mm.

A foot 42 is coupled to the first member 12. The foot 42 is one of a plurality of feet 42. Further, each of the plurality of feet 42 is positioned at an associated one of the centrally positioned bend 16, the curved section 22 of the first portion 18 and the curved section 26 of the second portion 20 of the first member 12. Additionally, the plurality of feet 42 comprise a pair of sets of feet 44. Each of the pair of sets of feet 44 are positioned on an associated one of a top side 46 and a bottom side 48 of the first member 12. The plurality of feet 42 abut the billiard table 14 when the first member 12 is positioned on the billiard table 14 so the first member 12 is supported above the billiard table 14.

A band 50 is coupled to the first member 12. The band 50 may be comprised of a flexible material such as rubber or other similar material. Additionally, the band 50 may have a length between 7 cm and 10 cm and a height between 4 cm and 5 cm. Moreover, the band 50 is one of a pair of bands 52.

A first band groove 51 extends inwardly from the inside surface 30 if the curved section 22 of the first portion 18 of the first member 12. A first one of the pair of bands 56 extends into the first band groove 51. The first band 56 is aligned with a first peg aperture 60 extending through an outside surface 62 and an inside surface 64 of the curved section 22 of the first portion 18 of the first member 12. A second band groove 53 extends inwardly from the inside surface 36 of the curved section 26 of the second portion 28 of the first member 12. A second one of the pair of bands 66 extends into the second band groove 53. The second band 66 is aligned with a second peg aperture 70 extending through an outside surface 72 and an inside surface 74 of the curved section 26 of the second portion 20 of the first member 12. Each of the first 60 and second 70 peg apertures may have a diameter between 2 mm and 4 mm.

A pair of first pegs 76 each extends through an associated one of the first peg aperture 60 and the second peg aperture 70. The pair of first pegs 76 engages an associated one of the first band 56 and the second band 66 so the first 56 and second 66 bands are retained on the first member 12. Additionally, each of the pair of first pegs 76 may have a length between 6 mm and 9 mm. Each of the pair of first pegs 76 may have a diameter between 2 mm and 4 mm.

A second member 78 is provided. A first curved section 80 proximate a first end 82 of the second member 78 is curved forwardly from a central section 84 of the second member 78. The first curved section 80 of the second member 78 is hook shaped. Continuing, a second curved section 86 proximate a second end 88 of the second member 78 is curved forwardly from the central section 84 of the second member. Additionally, the second curved section 86 of the second member 78 is hook shaped. The second member 78 may have a length between 28 cm and 30 cm, a height between 5 cm and 6 cm and a thickness between 6 mm and 9 mm.

A first band groove 90 extends inwardly from an outside surface 92 of the first curved section 80 of the second member 78 proximate the first end 82 of the second member 78. The first band 56 extends into the first band groove 90. Moreover, the first band 86 is aligned with a first peg well 94 extending through a front side 91 and a rear side 93 of the curved section 80 of the second member 78 proximate the first end 82 of the second member 78. The first peg well 94 intersects the first band groove 90.

A second band groove 96 extends inwardly from an outside surface 98 of the second curved section 86 of the second member 78 proximate the second end 88 of the second member 78. The second band 66 extends into the second band groove 96. Additionally, the second band 66 is aligned with a second peg well 11 extending through the front side 91 and the rear side 93 of the second curved section 86 of the second member 78 proximate the second end 88 of the second member 78. Lastly, the second peg well 11 intersects with the second band groove 96.

A pair of second pegs 13 each extends into an associated one of the first 94 and second 11 peg wells and engages an associated one of the first 56 and second 66 bands so the second member 78 is coupled to the first 56 and second 66 bands. Each of the pair of second pegs 13 may have a length between 4 mm and 7 mm. Continuing, the first curved section 80 of the second member 78 is positioned proximate a second one of the pair of troughs 15 on the curved section 22 of the first portion 18 of the first member 12. Additionally, the second curved section 86 of the second member 78 is positioned proximate a second one of the pair of troughs 17 on the curved section 26 of the second portion 20 of the first member 12.

A pair of first finger indentations 19 extends into the outside surfaces 62, 72 of an associated one of the curved sections 22, 26 of each of the first 18 and second 20 portions of the first member 12. Additionally, the pair of first finger indentations 19 extends between the top side 46 and the bottom side 48 of the first member 12. A pair of second finger indentations 21 extends into the outside surfaces 92, 98 of an associated one of each of the first 80 and second 86 curved sections of the second member 78. Further, the pair of second finger indentations 21 extends between a top side 23 and a bottom side 25 of the second member 78. The second member 78 forms a triangular shape with respect to the first member 12. Lastly, the second member 78 may arrange a plurality of billiard balls 27 between the first 12 and second 78 members in the convention of 8-ball billiards.

Alternatively, the first member 12 may be one of a pair of first members 12. The first 18 and second 20 portions of each of the pair of first members 12 are terminated at a flat free end 29, 31 of the first 18 and second 20 portions of the pair of first members 12. Moreover, the first 56 and second 66 bands are coupled between each of the flat free ends 29, 31 of the first 18 and second 20 portions of each of the pair of first members 12. A forward one of the pair of first members 33 forms a diamond shape with respect to a rearward one of the pair of first members 35. Lastly, the rearward first member 35 may arrange the plurality of billiard balls 27 between the rearward 35 and the forward 33 first members in the convention of 9-ball billiards.

In use, the assembly 10 is positioned on the billiard table 14. The plurality of billiard balls 27 is positioned between the first member 12 and the second member 78. Continuing, the second member 78 is urged forwardly toward the first member 12 so the plurality of billiard balls 27 are compressed together between the first 12 and second 78 members in the convention of 8-ball billiards. The assembly 10 is removed from the billiard table 14 after the plurality of billiard balls 27 is compressed together. Alternatively, the rearward first member 35 is urged forwardly toward the forward first member 33 after the plurality of billiard balls 27 is positioned between the forward 33 and rearward 35 first members.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An adjustable rack assembly for arranging billiard balls comprising:

a first member configured to be positioned on a billiard table;

a band operationally coupled to said first member; and a second member coupled to said band; wherein said second member is movably coupled to said first member;

wherein said second member is configured to arrange the billiard balls between said first and second members;

wherein said first member comprising a centrally positioned bend defining a first portion of said first member forming an acute inside angle with respect to a second portion of said first member;

wherein said first member and said second member form an overall shape of the billiards ball rack;

wherein the second member is movable with respect to the first member via the band.

2. The assembly according to claim 1 wherein a curved section proximate a free end of a first portion of said first member being curved inwardly toward a second portion of said first member; wherein said curved section of said first portion of said first member is hook shaped.

3. The assembly according to claim 1 wherein a curved section proximate a free end of a second portion of said first member being curved inwardly toward a first portion of said first member; wherein said curved section of said second portion of said first member is hook shaped.

4. The assembly according to claim 1 wherein an inside surface of a curved section of a first portion of said first member being scalloped; wherein a peak is defined between a pair of troughs on said inside surface of said curved section of said first portion of said first member.

5. The assembly according to claim 1 wherein an inside surface of a curved section of a second portion of said first member being scalloped; wherein a peak is defined between a pair of troughs on said inside surface of said curved section of said second portion of said first member.

6. The assembly according to claim 1 wherein said band being coupled to said first member such that a back side of said band abuts an inside surface of said first member.

7. The assembly according to claim 1 wherein said band being one of a pair of said bands.

8. The assembly according to claim 7 wherein a first one of said pair of bands being coextensive with a first one of a pair of troughs in a curved section of a first portion of said first member such that said first band is aligned with a first peg aperture extending through an outside surface and an inside surface of said curved section of said first portion of said first member.

9. The assembly according to claim 7 wherein a second one of said pair of bands being coextensive with a first one of a pair of troughs in a curved section of a second portion of said first member such that said second band is aligned with a second peg aperture extending through an outside surface and an inside surface of said curved section of said second portion of said first member.

10. The assembly according to claim 1 wherein a pair of first pegs each extending through an associated one of a first peg aperture and a second peg aperture wherein said pair of first pegs engages an associated one of a first band and a second band wherein said first and second bands are retained on said first member.

11. The assembly according to claim 1 wherein a first curved section proximate a first end of said second member being curved forwardly from a central section of said second member wherein said first curved section of said second member is hook shaped.

12. The assembly according to claim 1 wherein a second curved section proximate a second end of said second member being curved forwardly from a central section of said second member wherein said second curved section of said second member is hook shaped.

13. The assembly according to claim 1 wherein a first band groove extending inwardly from an outside surface of a first curved section of said second member proximate a first end of said second member.

14. The assembly according to claim 1 wherein a second band groove extending inwardly from an outside surface of a second curved section of said second member proximate a second end of said second member.

15. The assembly according to claim 14 wherein the band is further defined as a first band and a second band; wherein the first band extends into a first band groove; wherein said first band is aligned with a first peg well extending into an outside surface of a first curved section of said second member proximate a first end of said second member.

16. The assembly according to claim 15 wherein the second band extends into a second band groove; wherein said second band is aligned with a second peg well extending into an outside surface of a second curved section of said second member proximate a second end of said second member.

17. The assembly according to claim 16 wherein a pair of second pegs each extending into an associated one of a first and a second peg well and engaging an associated one of the first band and the second band; wherein said second member is coupled to said first and second bands.

18. The assembly according to claim 1 wherein:

a first curved section of said second member being positioned proximate a first trough on a curved section of a first portion of said first member; and a second curved section of said second member being positioned proximate a second trough on a curved section of a second portion of said first member wherein said second member forms a triangular shape with respect to said first member.

* * * * *